US006148798A

United States Patent [19]

Braun et al.

[11] Patent Number: 6,148,798

[45] Date of Patent: Nov. 21, 2000

[54] COAXIAL FLOW THROUGH FUEL RAIL WITH A DAMPER FOR A RECIRCULATING FUEL SYSTEM

[75] Inventors: Charles Wilson Braun, Livonia; Curtis David Lamb, Scottsville; Michael Roland Brosseau, Rochester; Grover Wesley Preston, Livonia, all of N.Y.

[73] Assignee: Delphi Technologies, Inc., Troy, Mich.

[21] Appl. No.: 09/411,338

[22] Filed: Oct. 1, 1999

[51] Int. Cl.[7] ..... F02M 41/00

[52] U.S. Cl. ..... 123/467; 123/456; 123/468

[58] Field of Search ..... 123/457, 456, 123/467, 514, 447, 468, 469; 138/30, 26

[56] References Cited

U.S. PATENT DOCUMENTS

| | | | |
|---|---|---|---|
| 4,474,160 | 10/1984 | Gartner | 123/468 |
| 4,660,524 | 4/1987 | Bertsch et al. | 123/468 |
| 5,233,963 | 8/1993 | Gregorius et al. | 123/456 |
| 5,333,587 | 8/1994 | DiSilvestro et al. | 123/456 |
| 5,575,262 | 11/1996 | Rohde | 123/467 |
| 5,617,827 | 4/1997 | Eshleman et al. . | |
| 5,752,486 | 5/1998 | Nakashima et al. | 123/467 |
| 5,845,621 | 12/1998 | Robinson et al. | 123/456 |
| 5,896,843 | 4/1999 | Lorraine | 123/467 |

*Primary Examiner*—Carl S. Miller
*Attorney, Agent, or Firm*—John A. VanOphem

[57] ABSTRACT

A fuel rail has a high pressure inlet and a low pressure outlet. The high pressure inlet feeds pressurized fuel to a plurality of injectors along the fuel rail. A fuel return line, which is connected with the low pressure outlet, is positioned substantially centrally of and coaxial with the fuel rail. The fuel return line is non-circular in configuration having a width to height ratio greater than one. The configuration of the return fuel line and the flexibility of the walls thereof provide a damper that reduces the pressure pulsations in the high pressure fuel.

4 Claims, 2 Drawing Sheets

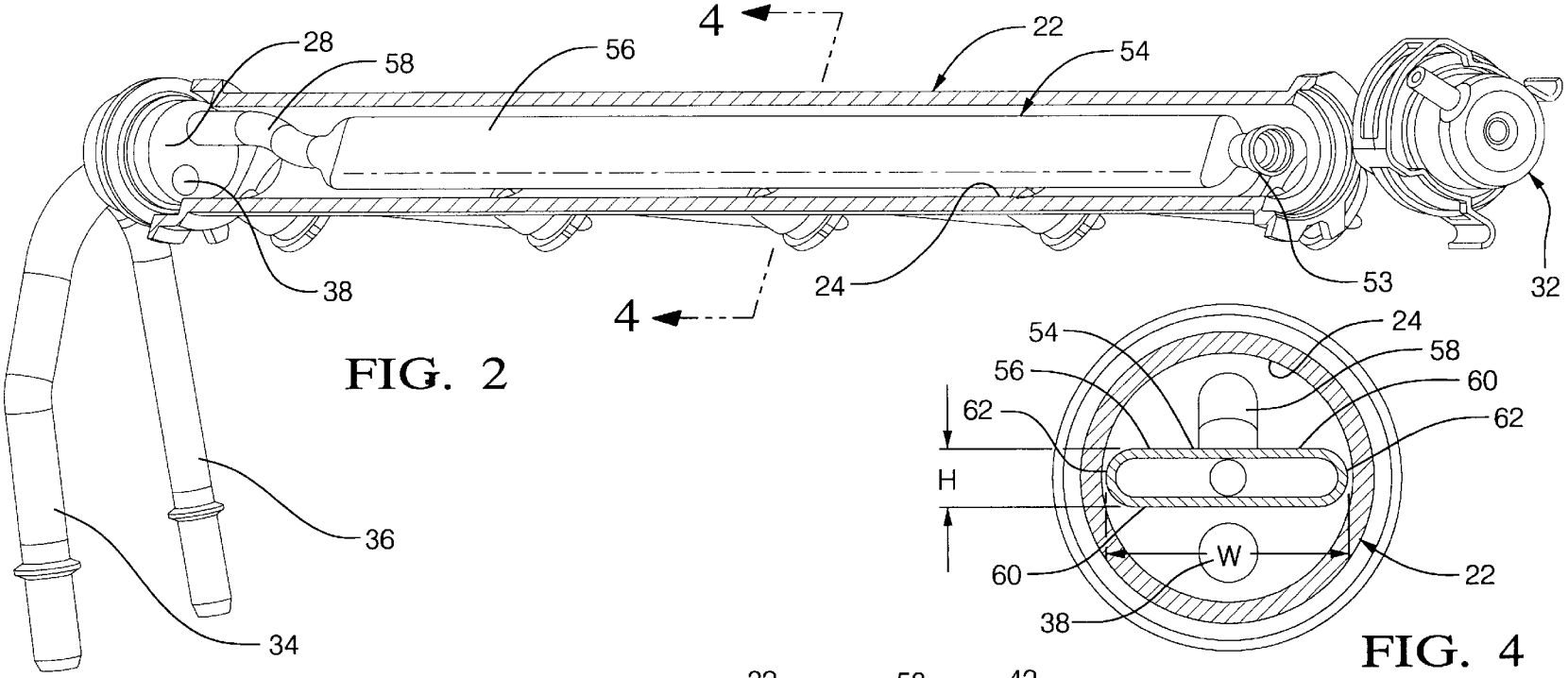
FIG. 2
FIG. 4
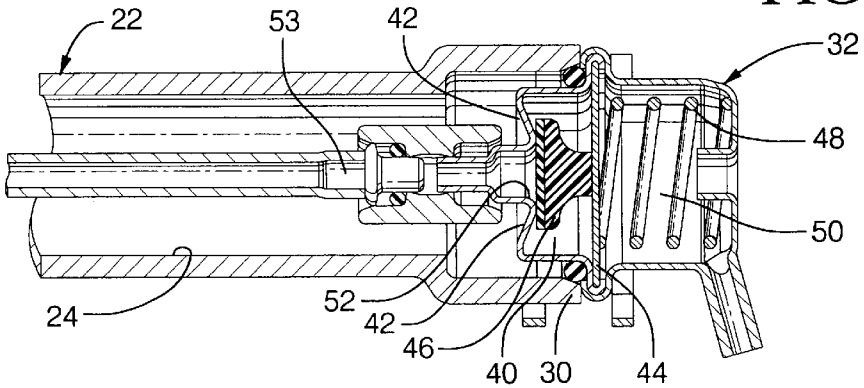
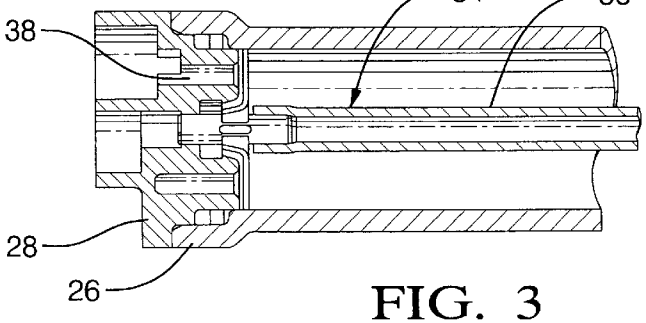
FIG. 3

COAXIAL FLOW THROUGH FUEL RAIL WITH A DAMPER FOR A RECIRCULATING FUEL SYSTEM

TECHNICAL FIELD

This invention relates to fuel systems and more particularly to recirculating fuel systems having a fuel rail.

BACKGROUND OF THE INVENTION

Many modern automobiles incorporate fuel injected engines which require a higher pressure fuel feed upstream of the fuel injector than is found in carbureted engines. The fuel injection system incorporates a plurality of injectors that deliver fuel to the inlet ports of the engine. The injectors are mounted in a fuel rail that supplies high pressure fuel to the input of the injectors. Most fuel injected engines use electromagnetic fuel injectors which deliver fuel in metered pulses that are timed to provide the amount of fuel needed in accordance with the operating condition of the engine.

The operation of the electromagnetic injectors induce pressure pulsations in the fuel rail such that a dampening system is needed to reduce the pressure pulses and vibrations that occur. To accommodate the increased pressure and reduce the effect of the pressure pulsations, suppliers have incorporated dampers into the fuel system. One such dampening system is described in U.S. Pat. No. 5,617,827 issued to Eshleman et al. on Apr. 8, 1997. The systems using a dampening mechanism generally do not have a fuel return line. If a fuel return line is incorporated in the system, it has been historically positioned externally of the fuel rail.

SUMMARY OF THE INVENTION

It is an object of the present invention to provide an improved fuel system.

In one aspect of the present invention, coaxial fuel rail and fuel return lines are provided. In another aspect of the present invention, the fuel return line is positioned substantially centrally of the fuel feed rail. In yet another aspect of the present invention, the fuel return line is non-circular.

In still another aspect of the present invention, the fuel return line is a damper structure for the pulsations in the fuel feed rail. In a further aspect of the present invention, the fuel return line has a width W and a height H such that W/H is greater than one. In yet a further aspect of the present invention, the return fuel line has a wall that is sufficiently flexible to provide dampening in response to pressure pulsations in the fuel feed line.

The present invention employs a fuel system having a fuel rail with an inlet port that is supplied with high pressure fuel from a fuel pump. The fuel rail also has a fuel outlet that is connected with a plurality of fuel injectors that are effective to supply atomized fuel to a manifold or to engine cylinders. The action of the injectors creates pressure pulsations or pressure perturbations within the fuel rail.

A fuel return line is positioned substantially centrally of the fuel rail to provide a passage for the return of excess fuel to a reservoir. The return line has an oval cross-section that provides flexibility or compliance in the system. The pressure pulsations cause the walls of the return line to be deflected thereby effectively dampening the pressure pulsations prior to the pressurized fuel being delivered to the fuel rail outlets.

BRIEF DESCRIPTION OF THE DRAWINGS

FIG. 2 is an isometric view, partly in section of a fuel rail incorporating the present invention and used in the engine fuel system shown in FIG. 1.

FIG. 3 is a sectional view taken along line 3—3 in FIG. 1.

FIG. 4 is a sectional view taken along line 4—4 in FIG. 2.

DESCRIPTION OF THE PREFERRED EMBODIMENT

Figure 1:
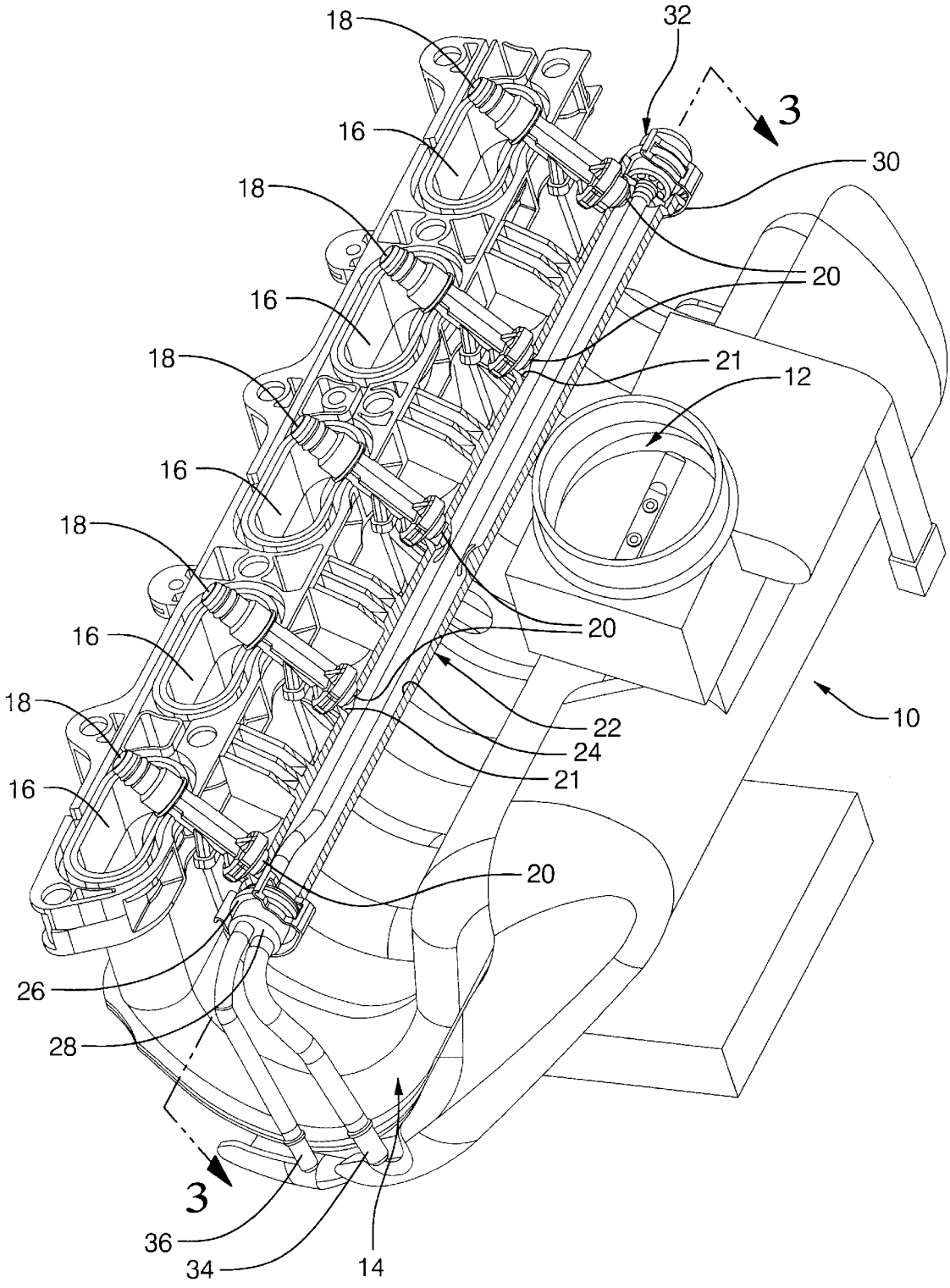
FIG. 1 is an isometric view of a portion of an engine fuel system.

An integrated air fuel module 10 (FIG. 1) for an internal combustion engine, not shown, has a throttle valve 12 that controls air flow to an inlet manifold 14. The inlet manifold 14 has a plurality of air passages 16 each of which connects with a mixing chamber or engine inlet port, not shown. Each air passage 16 has a fuel injector 18 positioned adjacent thereto. The injectors 18 deliver atomized fuel to the mixing chamber. The air/fuel mixture is directed from the mixing chamber to combustion cylinders of the engine. In the alternative, the air passages 16 can be directly connected with respective combustion cylinders and the injectors 18 will deliver fuel directly to respective cylinders.

The fuel injectors 18 are conventional devices that are well-known in the art. Each injector 18 has an inlet 20 that is in fluid communication with respective sockets or ports 21 in a fuel rail 22. As best seen in FIGS. 2 and 3, the fuel rail 22 has a substantially cylindrical portion 24 that is closed at one end 26 by a plug 28 and at the other end 30 by a pressure regulator valve assembly 32. The cylindrical portion 24 communicates with the inlets 20 through the sockets 21. The plug 28 has a fuel inlet conduit 34 and a fuel return conduit 36 connected therewith. The fuel inlet conduit communicates with the internal area of the cylindrical portion 24 through a port 38 formed in the plug 28.

The pressure regulator valve assembly 32 is a conventional device having a pressure chamber 40, regulator inlet ports 42, a diaphragm 44, a valve 46, a bias spring 48 and a bias chamber 50. The valve 46 is urged by the diaphragm 44 and the spring 48 to close an outlet port 52 that communicates with a damper inlet passage 53 of a fuel return member or line 54. The fuel return member 54 has a main or central section 56 and an outlet conduit 58. The outlet conduit 58 is connected for fluid communication with the return conduit 36 through the plug 28.

The central section 56 is substantially non-circular in cross-section having side walls 60 with a width W and end walls 62 having a height H. The width W is equal to or greater than the height H. Excess fuel is returned to a fuel reservoir, not shown, through the return line 54, the plug 28 and the return conduit 36. The return fuel is at a much lower pressure level than the fuel in the rail 22. As the injectors 18 are operated, a pressure pulsation resulting in a wave that is propagates along the fuel rail 22. The pressure pulsation can interfere with the proper distribution of fuel to the inlets 20 of the injectors 18. With the present invention, the central section 56 will dampen the pressure pulsations and reduce or eliminate the pressure wave. The non-circular cross-section permits flexing of the side walls 60 of the central section 56 to accommodate the dampening of the pressure pulsations. Any resultant pulsations in the fuel return conduit will be minor and have no effect on the fuel system. While the central section 56 is shown as rectangular in the exemplary embodiment, a square or oval cross-section will accomplish the desired dampening effect. Large corner radii are preferably incorporated in the structure to reduce the influence of inherent stresses that occur during flexing of the side walls.

The positioning of the fuel return line within the fuel rail also reduces the under hood space required to route an external conduit from the regulator valve 32 to the fuel tank. Since the return conduit is preferably positioned parallel to the fuel feed conduit when they are routed along the vehicle frame, the centrally disposed fuel return accommodates this disposition of the fuel conduits without the need to pass the fuel return line across the engine. However, the major benefit of having the fuel return line 54 centrally disposed in the fuel rail is to provide an integral damper for the fuel system. While a substantially rectangular or oval configuration is preferred, other configuration wherein the side dimensions (width) are greater than or equal to the end dimensions (height) such that the desired flexing of the conduit will occur.

What is claimed is:

1. A fuel rail assembly for a fuel injection system comprising:

a fuel feed passage having a longitudinally extending, substantially cylindrical wall, first and second ends and fuel injector ports formed between said ends disposed to provide fluid communication of the fuel feed passage with respective fuel injectors positioned in said sockets;

a pressure regulator valve secured in said first end of said fuel feed passage having an inlet port in fluid communication with said fuel feed passage and an outlet port, said pressure regulator valve being operable to establish a first pressure level in said fuel feed passage;

a plug secured in said second end of said fuel feed passage having a fuel feed conduit disposed in fluid communication with said fuel feed passage and a fuel return conduit;

a fuel return member having an inlet passage connected with said outlet port of said pressure regulator valve, an outlet conduit connected with said fuel return conduit, and a central section extending between said inlet passage and said outlet conduit substantially centrally and coaxial with said cylindrical wall, said central section transporting return fuel between said regulator valve outlet port and said return fuel conduit at a second pressure level less than said first pressure level, said central section having a width dimension greater than a height dimension to provide a compliant structure to effectively reduce any pressure pulsations and pressure waves arising in said fuel feed passage.

2. A fuel rail assembly for a fuel injection system comprising:

a longitudinally extending fuel feed portion having pressurized fuel supplied thereto;

a valve for controlling a first fuel pressure level in said fuel feed portion; and a fuel return member disposed substantially centrally of said fuel feed portion, said return member having one end thereof communicating with said valve for admitting return fuel into said fuel return member at a second fuel pressure level which is lower than said first fuel pressure level, a main section receiving fuel from said one end, and an outlet conduit for delivering fuel from said fuel rail, said main section being non-circular in a longitudinal direction and having flexible side walls that are effective to dampen pressure pulsations in said fuel rail external to said fuel return member.

3. The fuel rail assembly for a fuel injection system defined in claim 2 wherein said main section has a substantially a cross-section with a width dimension greater than a height dimension.

4. The fuel rail assembly for a fuel injection system defined in claim 2 wherein said main section has a substantially a cross-section with a width dimension substantially equal to a height dimension.

* * * * *